US008267705B2

(12) United States Patent
Huang

(10) Patent No.: US 8,267,705 B2
(45) Date of Patent: Sep. 18, 2012

(54) ELECTRONIC DEVICE WITH DETACHABLE PLUG CAPABLE OF CHANGING PLUGGING DIRECTION

(75) Inventor: Chin-Chu Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 190 days.

(21) Appl. No.: 12/648,019

(22) Filed: Dec. 28, 2009

(65) Prior Publication Data

US 2011/0039435 A1 Feb. 17, 2011

Related U.S. Application Data

(60) Provisional application No. 61/232,980, filed on Aug. 11, 2009.

(51) Int. Cl.
*H01R 29/00* (2006.01)

(52) U.S. Cl. ..... 439/171

(58) Field of Classification Search ..... 439/52, 439/171–175, 218
See application file for complete search history.

(56) References Cited

U.S. PATENT DOCUMENTS 6,328,581 B1 * 12/2001 Lee et al. ..... 439/106
7,264,492 B2 * 9/2007 Liang ..... 439/171
7,946,884 B2 * 5/2011 Chiang et al. ..... 439/518

* cited by examiner

*Primary Examiner* — Vanessa Girardi
(74) *Attorney, Agent, or Firm* — Kirton McConkie; Evan R. Witt

(57) ABSTRACT

An electronic device with a detachable plug capable of changing plugging direction is disclosed. The electronic device comprises a main body and a plug. The main body has a plug-receiving portion, and the plug-receiving portion comprises at least two conducting pieces. The plug has a plug body and at least two conductive terminals. The plug body comprises four trenches disposed at a bottom thereof and arranged as a square. Each of the conductive terminals comprises a plugging portion, a connection portion and an extension portion, wherein the plugging portion is protruded out of a surface of the plug body, and the connection portion and the extension portion are embedded in the plug body and are corresponding to two adjacent trenches, respectively. Thereby, when the plug is assembled on the plug-receiving portion of the main body, the two conducting pieces are respectively received in two opposite trenches and contacted with either the two connection portions or the two extension portions of the two conductive terminals for power conduction.

19 Claims, 8 Drawing Sheets

ELECTRONIC DEVICE WITH DETACHABLE PLUG CAPABLE OF CHANGING PLUGGING DIRECTION

CROSS-REFERENCE TO RELATED APPLICATIONS

This application claims the benefit of prior U.S. provisional application 61/232,980, which is entitled "ELECTRONIC DEVICE WITH DETACHABLE PLUG" and filed Aug. 11, 2009.

FIELD OF THE INVENTION

The present invention relates to an electronic device with a detachable plug, and more particularly to an electronic device with a detachable plug capable of changing plugging direction.

BACKGROUND OF THE INVENTION

With the progress of technology, various electronic equipments become indispensable tools in our daily life. The power converter functions to convert the commercial AC power into DC power to be utilized by the electronic equipments. For example, the adapter of a notebook, or the charger of a cellphone or a digital camera, is a kind of power converter.

The power converter includes a plug for plugging into a socket to receive the commercial power. Since the international business is well developed and the leisure life quality is much valued nowadays, people frequently and frequently go abroad for business or travel, and usually carry the portable electronic products, such as notebooks, cellphones and digital cameras, when they go abroad. However, there are various kinds of socket standards in the world, so the power converter is usually connected with a connector having different forms of conductive terminals to adapt to different socket standards.

Most power converters are wall-mounted power converters, whose plug is protruded from the main body of the power converter. Since the main body of the power converter has certain volume, when the power converter is plugged into a wall socket or a socket of an extension cable, the power converter may interfere the objects around the socket due to the plugging direction of the power converter, which makes it difficult to plug or pull out the power converter onto or from the socket. Under some conditions, the rest holes on the socket may be obstructed by the power converter plugged onto the socket, which causes those socket holes cannot be further utilized.

To overcome the disadvantages of the prior art described above, the present invention provides a power converter with a detachable plug, wherein the plugging direction of the power converter can be changed according to different requirements so as to increase the practicability of the power converter.

SUMMARY OF THE INVENTION

It is an object of the present invention to provide an electronic device with a detachable plug to enable the user to choose the assembling direction of the plug, so that the plugging direction of the electronic device can be changed according to different requirements so as to make the electronic device have a better space utilization when plugging onto a socket.

It is another object of the present invention to provide an electronic device with a detachable plug, wherein the number and the shapes of the conductive terminals of the plug can be varied to adapt to different socket standards to increase the practicability of the electronic device.

In accordance with a first aspect of the present invention, there is provided an electronic device with a detachable plug capable of changing plugging direction. The electronic device comprises a main body and a plug. The main body has a plug-receiving portion, and the plug-receiving portion comprises at least two conducting pieces. The plug has a plug body and at least two conductive terminals. The plug body comprises four trenches disposed at a bottom thereof and arranged as a square. Each of the conductive terminals comprises a plugging portion, a connection portion and an extension portion, wherein the plugging portion is protruded out of a surface of the plug body, and the connection portion and the extension portion are embedded in the plug body and are corresponding to two adjacent trenches, respectively. Thereby, when the plug is assembled on the plug-receiving portion of the main body, the two conducting pieces are respectively received in two opposite trenches and contacted with either the two connection portions or the two extension portions of the two conductive terminals for power conduction.

In accordance with a second aspect of the present invention, there is provided a plug to be assembled on a plug-receiving portion of a main body of an electronic device. The plug-receiving portion comprises at least two conducting pieces. The plug has a plug body and at least two conductive terminals. The plug body comprises four trenches disposed at a bottom thereof and arranged as a square. Each of the conductive terminals comprises a plugging portion, a connection portion and an extension portion, wherein the plugging portion is protruded out of a surface of the plug body, and the connection portion and the extension portion are embedded in the plug body and are corresponding to two adjacent trenches, respectively. Thereby, when the plug is assembled on the plug-receiving portion of the main body, the two conducting pieces are respectively received in two opposite trenches and contacted with either the two connection portions or the two extension portions of the two conductive terminals for power conduction.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention relates to an electronic device with a detachable plug capable of changing plugging direction. The present techniques are illustrated with the following embodiments for a power converter, such as adapter and charger, but the electronic device that is applicable to the present techniques is not limited to the power converter. Any electronic device that is applicable to the following techniques is incorporated herein for reference.

Figure 1:
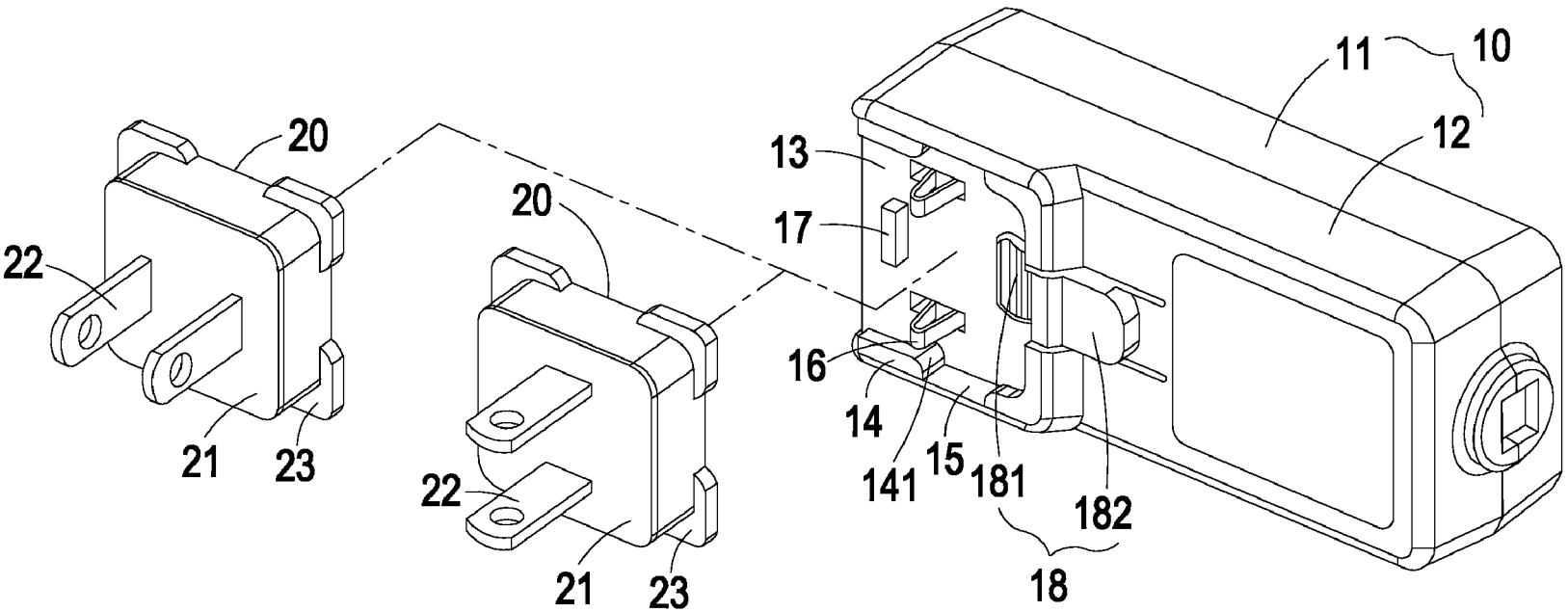
FIG. 1 is a schematic diagram showing the electronic device with a detachable plug according to a first embodiment of the present invention.

FIG. 1 is a schematic diagram showing the electronic device with a detachable plug capable of changing plugging direction according to a first preferred embodiment of the present invention. As shown in FIG. 1, the electronic device, such as a power converter, mainly comprises a main body 10 and a detachable plug 20. The main body 10 comprises an upper casing 11 and a lower casing 12, and the plug 20 is assembled with the main body 10 at the bottom of the lower casing 12.

There is a plug-receiving portion 13, which is a depression, disposed at the bottom of the lower casing 12 for receiving the plug 20. Two side plates 14 are disposed at two opposite sides of the plug-receiving portion 13, respectively. The side plates 14 are extended inwardly from bottom edges of the lower casing 12, and are formed integrally with the lower casing 12, but not limited thereto. Each of the side plates 14 has an indentation 15 serving as a guiding slot for assembling the plug 20 and the main body 10 of the electronic device. The plug-receiving portion 13 comprises at least two conducting pieces 16 for contacting with the conductive terminals 22 on the plug 20. Moreover, the plug-receiving portion 13 further comprises a block 17 disposed close to the edge of the plug-receiving portion 13 for preventing the plug 20 from being assembled to the main body 10 from incorrect direction.

The main body 10 of the electronic device further includes a locking component 18 having a locking latch 181 and a release button 182. The locking latch 181 is used to be engaged with the plug 20 and the release button 182 is used to release the engagement between the locking latch 181 and the plug 20, so as to further dissemble the plug 20 from the main body 10 of the electronic device.

Figure 2B:
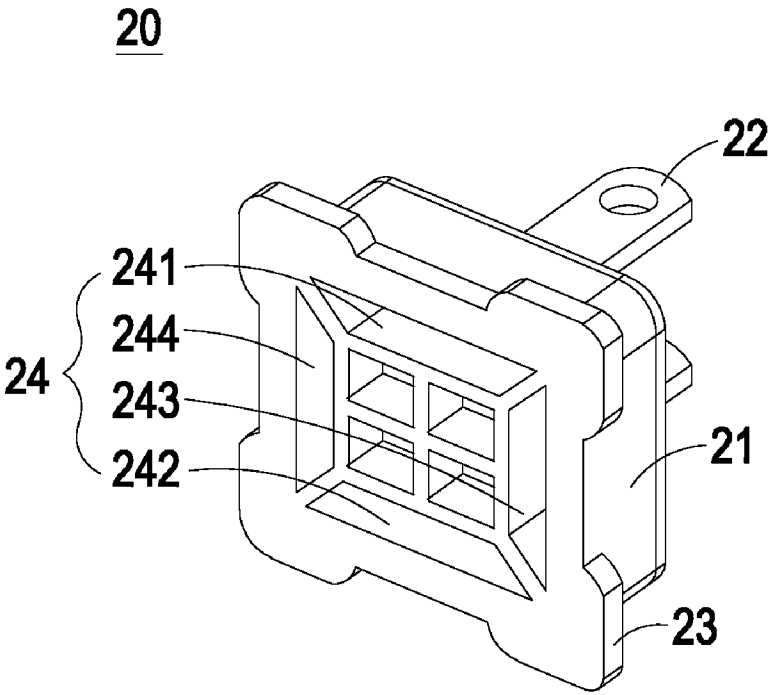
FIGS. 2A and 2B are schematic diagrams showing the plug from different views according to the first preferred embodiment of the present invention.
Figure 2A:
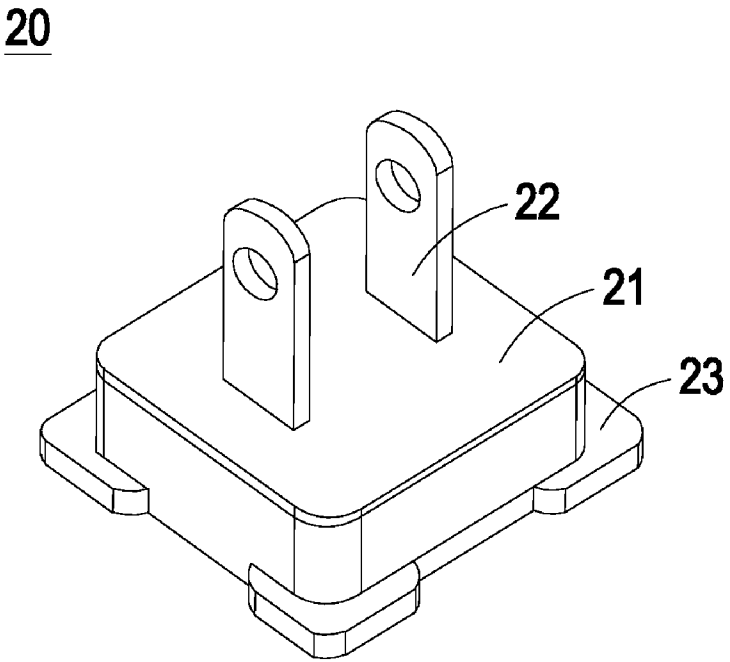
Figure 2C:
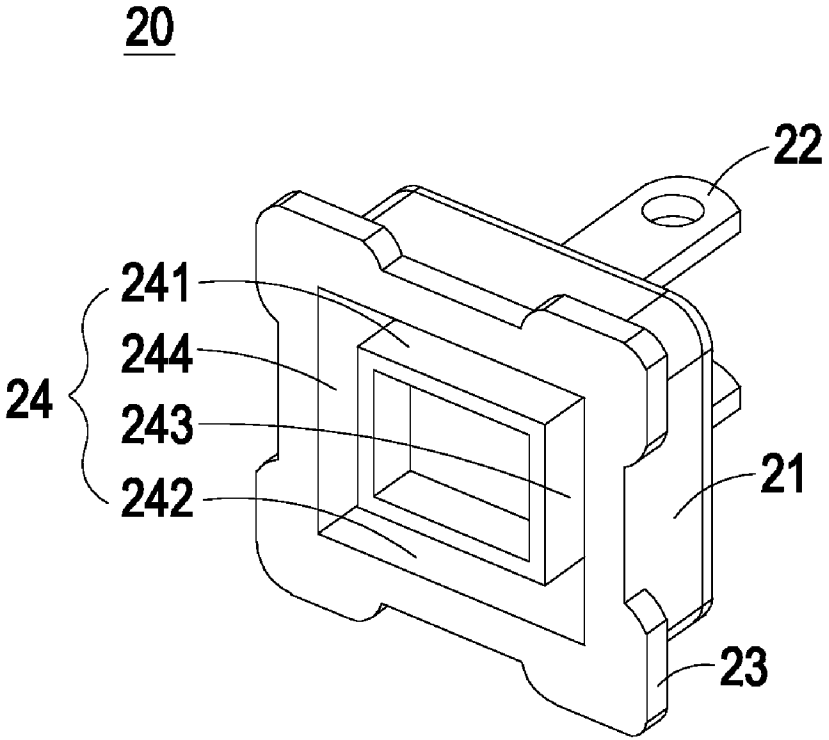
FIG. 2C is a bottom perspective view of the plug according to another embodiment.

Please refer to FIGS. 2A-2C, wherein FIG. 2A is a schematic diagram showing the plug of FIG. 1, and FIGS. 2B-2C are bottom views of the plug according to different embodiments. As shown in FIG. 2A, the plug 20 mainly comprises a plug body 21 and at least two conductive terminals 22. Certainly, the number and the shapes of the conductive terminals 22 can be designed according to different socket standards but not limited to the form shown in the figure.

As shown in FIG. 2A, the cross-section of the plug body 21 is substantially a square, and four flanges 23 are disposed in the four corners at the bottom surface of the plug body 21, in which any two adjacent flanges 23 are corresponding to and able to be received in the two indentations 15 of the two side plates 14 in the plug-receiving portion 13. As shown in FIG. 2B, which is a bottom view of the plug 20, there are four trenches 24 disposed at the bottom of the plug body 21. The four trenches 24 include a first trench 241, a second trench 242, a third trench 243 and a fourth trench 244. The four trenches 24 are arranged as a square and corresponding to the four sides of the plug body 21, wherein the first trench 241 and the second trench 242 are opposite to each other, and the third trench 243 and the fourth trench 244 are opposite to each other.

As shown in FIG. 2C, which is a bottom view of the plug 20 according to another embodiment, there are also four trenches 24 disposed at the bottom of the plug body 21. The four trenches 24 include a first trench 241, a second trench 242, a third trench 243 and a fourth trench 244. The four trenches 24 are arranged as a square and corresponding to the four sides of the plug body 21, wherein the first trench 241 and the second trench 242 are opposite to each other, and the third trench 243 and the fourth trench 244 are opposite to each other. The difference between FIGS. 2B and 2C is that each of the first trench 241, the second trench 242, the third trench 243 and the fourth trench 244 in FIG. 2B has an independent opening at the bottom of the plug body 21, but the first trench 241, the second trench 242, the third trench 243 and the fourth trench 244 in FIG. 2C are communicated with each other and commonly have an opening at the bottom of the plug body 21 to form a surrounding trench 24.

Figure 3:
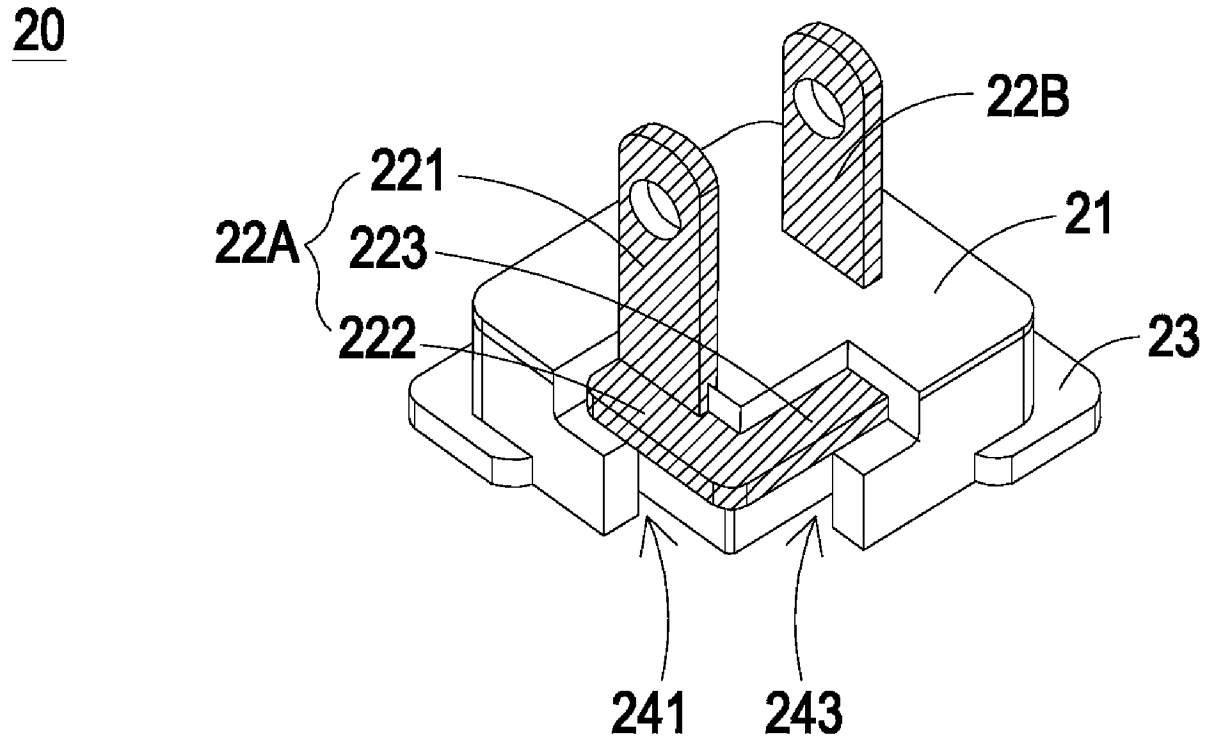
FIG. 3 is a partial perspective diagram showing the plug of FIG. 2A.

FIG. 3 is a partial perspective diagram showing the plug of FIG. 2A. A first conductive terminal 22A of the at least two conductive terminals 22 includes a plugging portion 221, a connection portion 222 and an extension portion 223. The plugging portion 221 is protruded out of the surface of the plug body 21 to be plugged into a power socket (not shown), and the connection portion 222 and the extension portion 223 are embedded in the plug body 21. In a preferred embodiment, the connection portion 222 and the extension portion 223 are substantially in an L-form, and are corresponding to the two adjacent trenches, such as the first trench 241 and the third trench 243, and disposed at the bottoms the first trench 241 and the third trench 243, respectively. Similarly, a second conductive terminal 22B of the at least two conductive terminals 22 also includes a plugging portion, a connection portion and an extension portion (not shown), wherein the connection portion and the extension portion are substantially in an L-form, and are corresponding to the two adjacent trenches, such as the second trench 242 and the fourth trench 244, and disposed at the bottoms the second trench 242 and the fourth trench 244, respectively.

Please refer to FIGS. 1-3. When assembling the plug 20 onto the main body 10 of the electronic device, two adjacent flanges 23 of the plug body 21 are aligned with the two indentations 15 of the two side plates 14 in the plug-receiving portion 13 to facilitate sliding the plug body 21 downwardly into the plug-receiving portion 13, and meanwhile, the two conducting pieces 16 are respectively inserted into two opposite trenches, such as the first trench 241 and the second trench 242. Subsequently, the plug body 21 is moved toward the locking component 18 till the locking latch 181 is engaged with the front trench, such as the third trench 243, to accomplish the assembling of the plug 20 and the main body 10 of the electronic device. In the mean time, the two conducting pieces 16 on the plug-receiving portion 13 are contacted with the two connection portions 222 of two different conductive terminals 22 through the first trench 241 and the second trench 242, respectively, so as to conduct the external power to the main body 10 of the electronic device when the plug 20 is plugged into a socket.

Since the plug body 21 has a symmetric structure and the conductive terminal 22 has the L-shaped connection portion 222 and extension portion 223 communicated with two adjacent trenches 24, when the plug 20 is rotated in an angle of 90 degrees, the plug 20 can also be assembled onto the main body 10 of the electronic device. For example, when the plug 20 shown in the right side of FIG. 1 is rotated in an angle of 90 degrees in clockwise direction to be as the plug 20 shown in the left side of FIG. 1, the second trench 242 is turn to be the front trench of the plug body 21 for assembling. When sliding the plug body 21 downwardly into the plug-receiving portion 13, the two conducting pieces 16 are respectively inserted into two opposite trenches 24, which are the third trench 243 and the fourth trench 244. Subsequently, the plug body 21 is moved toward the locking component 18 till the locking latch 181 is engaged with the front trench, which is the second trench 242, to accomplish the assembling of the plug 20 and the main body 10 of the electronic device. In the mean time, the two conducting pieces 16 on the plug-receiving portion 13 are contacted with the two extension portions 223 of two different conductive terminals 22 through the third trench 243 and the fourth trench 244, respectively, to conduct the external power to the main body 10 of the electronic device when the plug 20 is plugged into a socket.

Accordingly, since the plug 20 has four trenches 24 arranged as a square, and each of the conductive terminal 22 has the connection portion 222 and the extension portion 223 communicated with the two adjacent trenches 24, respectively, so that the conducting pieces 16 on the plug-receiving portion 13 can be always received in the two opposite trenches 24 and contacted with either the two connection portions 222 or the two extension portions 223 of the two different conductive terminals 22 for power conduction, no matter the plug 20 is assembled on the main body 10 of the electronic device in what direction. Therefore, by means of the structural design of the present invention, the user can choose the assembling direction of the plug 20, so that the plugging direction of the electronic device can be changed according to different requirements so as to make the electronic device have a better space utilization when plugging onto a socket.

On the other hand, when dissembling the plug 20 from the main body 10 of the electronic device, an external force is applied to the release button 182 so that the locking latch 181 is no longer engaged with the front trench of the plug 20. Thus, the plug 20 can be moved backward to the position where the flanges 23 are corresponding to the two indentations 15 of the two side plates 14, and then the plug 20 can be easily taken out from the main body 10 of the electronic device. In an embodiment, for avoiding the damage of the conducting pieces 16 during the backward moving process of the plug 16, the side plate 14 further includes a pillar 141 (as shown in FIG. 1) extended from the side plate 14 downwardly to the bottom surface of the plug-receiving portion 13. The pillars 141 are used as a block to stop the flanges 23 at the two indentations 15 of the two side plates 14 during the backward moving process of the plug 16, and facilitate dissembling the plug 20 from the main body 10 of the electronic device.

In addition, for avoiding the damage of the conducting pieces 16 due to the plug 20 is erroneously inserted into the plug-receiving portion 13 from the lateral side of the main body 10, the block 17 in the plug-receiving portion 13 is also used for preventing the plug 20 from being assembled to the main body 10 from incorrect direction.

In FIGS. 1-3, the plug 20 is illustrated to have two conductive terminals 22. However, the design of the present invention can also be applied the plug having three conductive terminals. Following is another embodiment of the present invention wherein the plug has three conductive terminals, but the forms of the conductive terminals are limited to those shown in the figure.

Figure 4:
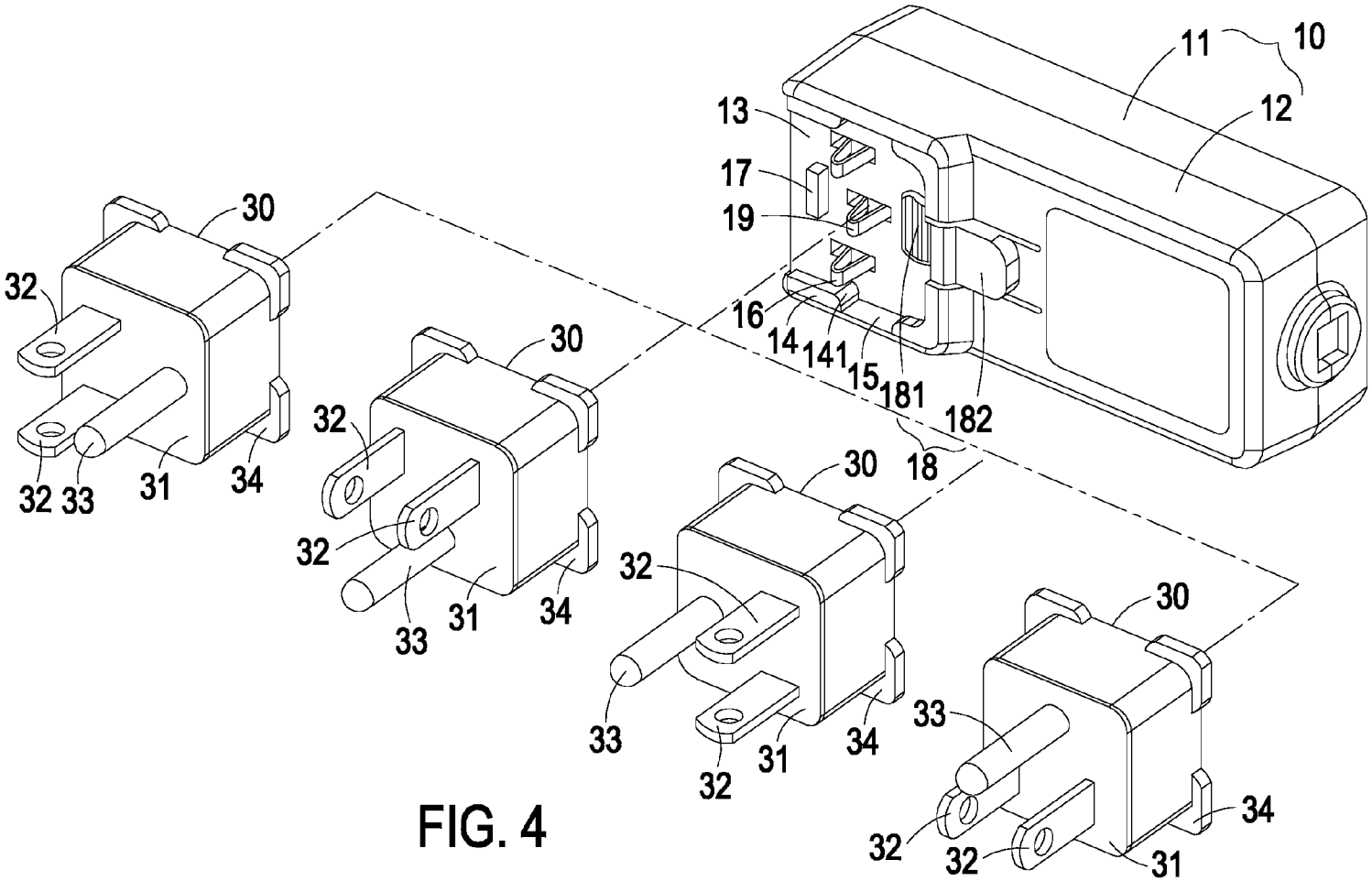
FIG. 4 is a schematic diagram showing the electronic device with a detachable plug according to a second preferred embodiment of the present invention.

FIG. 4 is a schematic diagram showing the electronic device with a detachable plug capable of changing plugging direction according to a second preferred embodiment of the present invention. As shown in FIG. 4, the electronic device, such as a power converter, mainly comprises a main body 10 and a detachable plug 30. The structure of the main body 10 in FIG. 4 is substantially the same as the main body 10 in FIG. 1, and the difference therebetween is that, in addition to the two conducting pieces 16, the main body 10 in FIG. 4 further includes a third conducting piece 19, which is disposed in the center of the plug-receiving portion 13.

Figure 5B:
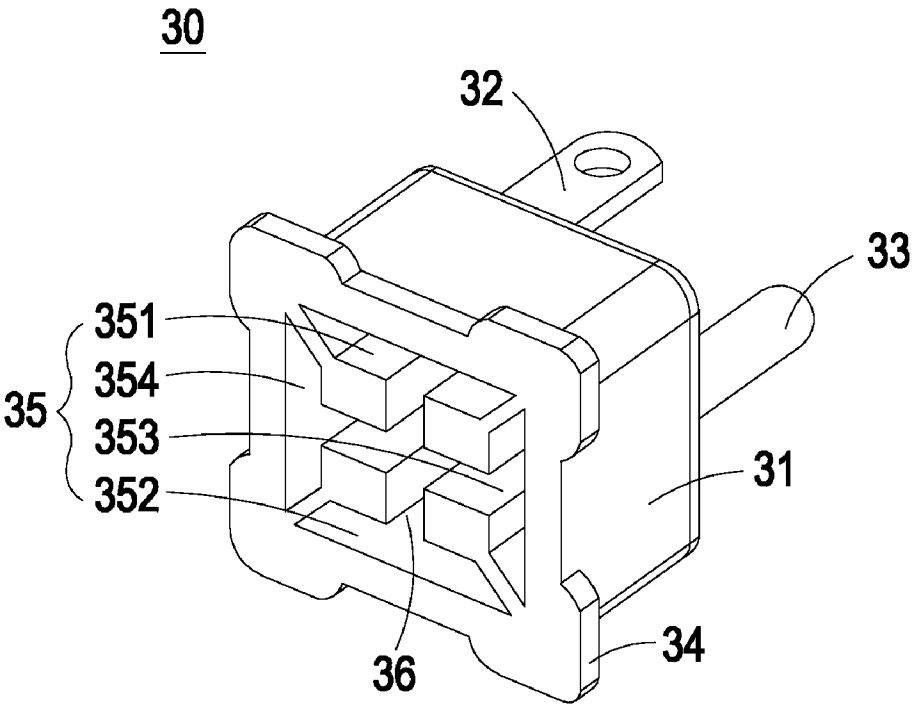
FIGS. 5A and 5B are schematic diagrams showing the plug from different views according to the second preferred embodiment of the present invention.
Figure 5A:
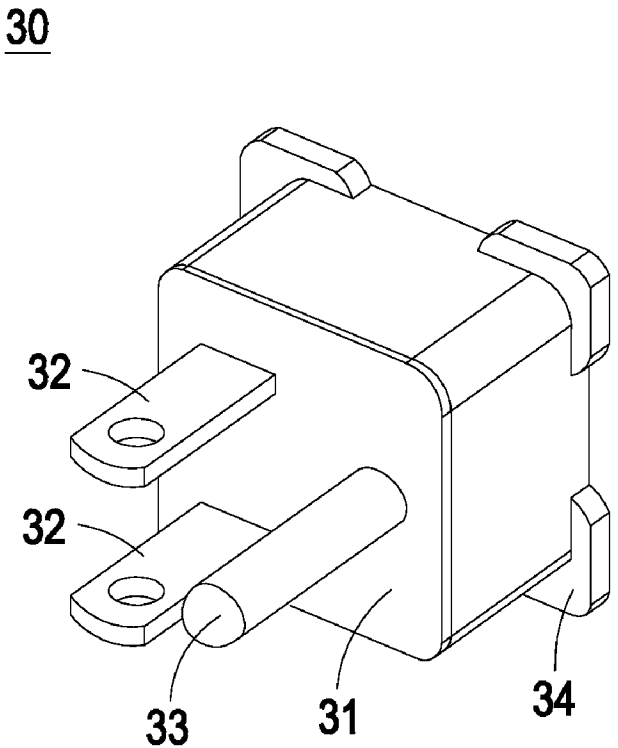
Figure 5C:
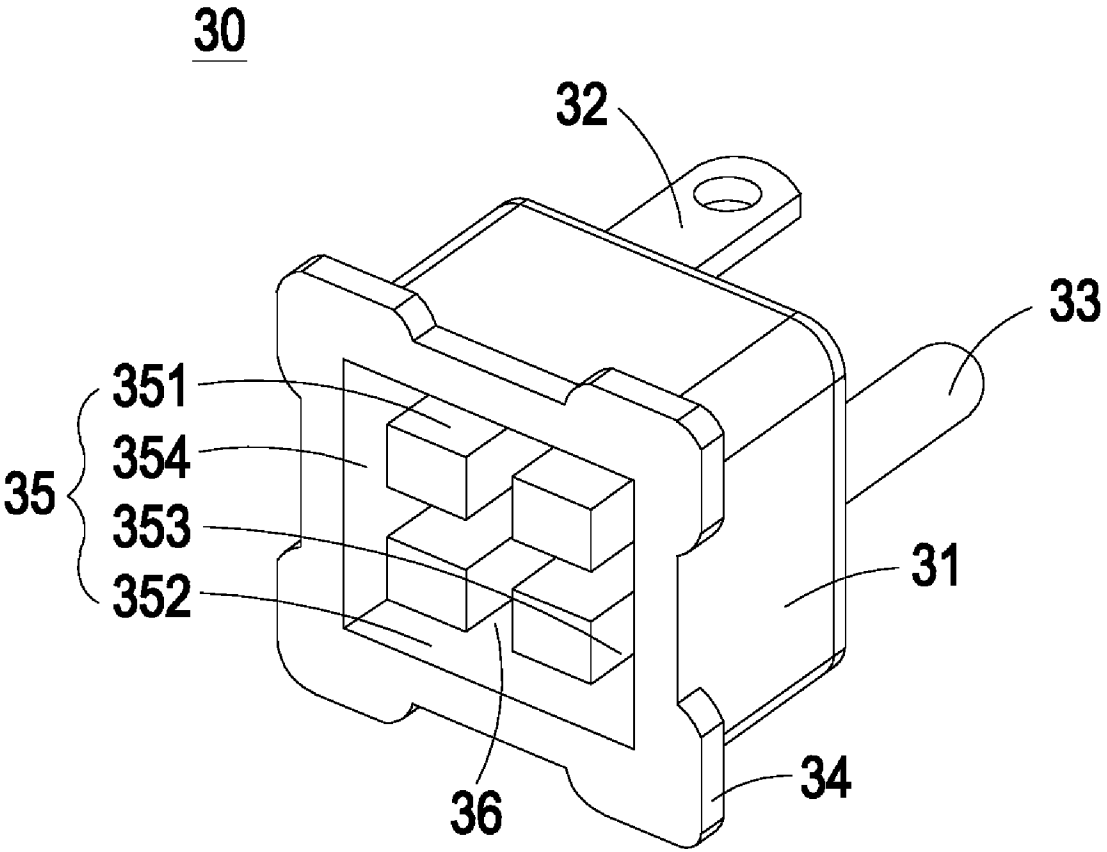
FIG. 5C is a bottom perspective view of the plug according to another embodiment.

Please refer to FIGS. 5A-5C, wherein FIG. 5A is a schematic diagram showing the plug of FIG. 4, and FIGS. 5B-5C are bottom views of the plug according to different embodiments. As shown in FIG. 5A, the plug 30 mainly comprises a plug body 31, two conductive terminals 32, and a ground conductive terminal 33. The cross-section of the plug body 31 is substantially a square, and four flanges 34 are disposed in the four corners at the bottom surface of the plug body 31, in which any two adjacent flanges 34 are corresponding to and able to be received in the two indentations 15 of the two side plates 14 in the plug-receiving portion 13. As shown in FIG. 5B, which is a bottom view of the plug 30, there are four trenches 35 disposed at the bottom of the plug body 31. The four trenches 35 include a first trench 351, a second trench 352, a third trench 353 and a fourth trench 354. The four trenches 35 are arranged as a square and corresponding to the four sides of the plug body 31, wherein the first trench 351 and the second trench 352 are opposite to each other, and the third trench 353 and the fourth trench 354 are opposite to each other. Moreover, a cross trench 36, which is extended from the center of the plug body 31 to the four trenches 351, 352, 353 and 354, is further provided at the bottom of the plug body 31. In an embodiment, the cross trench 36 is communicated with the four trenches 351, 352, 353 and 354, but not limited thereto.

As shown in FIG. 5C, which is a bottom view of the plug 30 according to another embodiment, there are also four trenches 35 disposed at the bottom of the plug body 31. The four trenches 34 include a first trench 351, a second trench 352, a third trench 353 and a fourth trench 354. The four trenches 35 are arranged as a square and corresponding to the four sides of the plug body 31, wherein the first trench 351 and the second trench 352 are opposite to each other, and the third trench 353 and the fourth trench 354 are opposite to each other. Moreover, a cross trench 36, which is extended from the center of the plug body 31 to the four trenches 351, 352, 353 and 354, is further provided at the bottom of the plug body 31. The difference between FIGS. 5B and 5C is that each of the first trench 351, the second trench 352, the third trench 353 and the fourth trench 354 in FIG. 5B has an independent opening at the bottom of the plug body 31, but the first trench 351, the second trench 352, the third trench 353 and the fourth trench 354 in FIG. 5C are communicated with each other and commonly have an opening at the bottom of the plug body 51 to form a surrounding trench 35.

Figure 6:
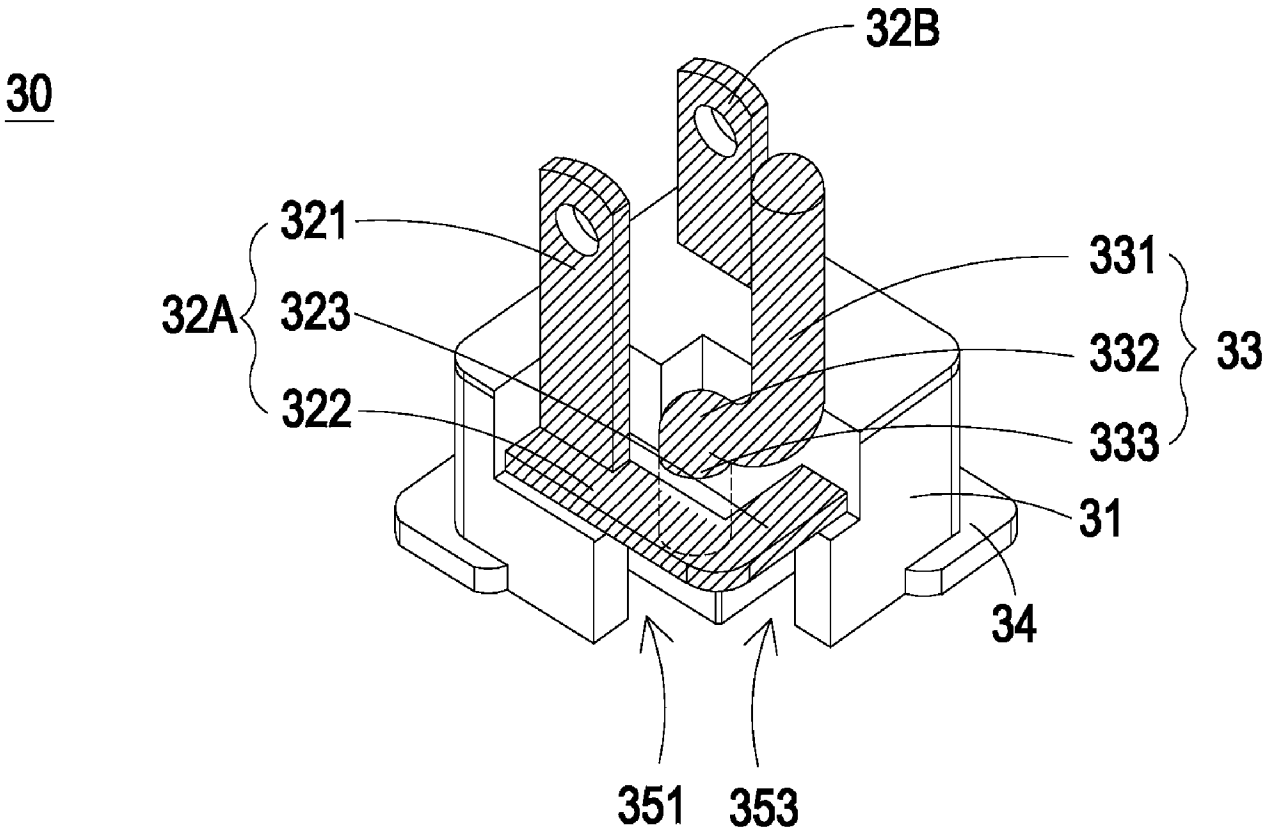
FIG. 6 is a partial perspective diagram showing the plug of FIG. 5A.

FIG. 6 is a partial perspective diagram showing the plug of FIG. 5A. A first conductive terminal 32A of the two conductive terminals 32 includes a plugging portion 321, a connection portion 322 and an extension portion 323. The plugging portion 321 is protruded out of the surface of the plug body 31 to be plugged into a power socket (not shown), and the connection portion 322 and the extension portion 323 are embedded in the plug body 31. In a preferred embodiment, the connection portion 322 and the extension portion 323 are substantially in an L-form, and are corresponding to the two adjacent trenches, such as the first trench 351 and the third trench 353, and disposed at the bottoms the first trench 351 and the third trench 353, respectively. Similarly, a second conductive terminal 32B of the two conductive terminals 32 also includes a plugging portion, a connection portion and an extension portion (not shown), wherein the connection portion and the extension portion are substantially in an L-form, and are corresponding to the two adjacent trenches, such as the second trench 352 and the fourth trench 354, and disposed at the bottoms the second trench 352 and the fourth trench 354, respectively.

The ground conductive terminal 33 also includes a plugging portion 331, a connection portion 332 and an extension portion 333. The plugging portion 331 is protruded out of the surface of the plug body 31 to be plugged into a power socket (not shown), and the connection portion 322 and the extension portion 323 are embedded in the plug body 31. To enable the ground conductive terminal 33 to be contacted with the third conducting piece 19 in the plug-receiving portion 13, the connection portion 332 of the ground conductive terminal 33 is extended to the center of the plug body 31 above the level where the connection portion 322 and the extension portion 323 of the conductive terminal 32A are located, and the extension portion 333 of the ground conductive terminal 33 is extended from the center of the plug body 31 downwardly to the level where the connection portion 322 and the extension portion 323 of the conductive terminal 32A are located.

Please refer to FIGS. 4-6. When assembling the plug 30 onto the main body 10 of the electronic device, two adjacent flanges 34 of the plug body 31 are aligned with the two indentations 15 of the two side plates 14 in the plug-receiving portion 13 to facilitate sliding the plug body 31 downwardly into the plug-receiving portion 13, and meanwhile, the two conducting pieces 16 are respectively inserted into two opposite trenches, such as the first trench 351 and the second trench 352, and the third conducting piece 19 is inserted into the cross trench 36. Subsequently, the plug body 31 is moved toward the locking component 18 till the locking latch 181 is engaged with the front trench, such as the third trench 353, to accomplish the assembling of the plug 30 and the main body 10 of the electronic device. In the mean time, the two conducting pieces 16 on the plug-receiving portion 13 are contacted with the two connection portions 322 of two different conductive terminals 32 through the first trench 351 and the second trench 352, respectively, and the third conducting piece 19 is contacted with the extension portion 333 of the ground conductive terminal 33 so as to conduct the external power to the main body 10 of the electronic device when the plug 30 is plugged into a socket.

Since the plug body 31 has a symmetric structure, the conductive terminal 32 has the L-shaped connection portion 322 and extension portion 323 communicated with two adjacent trenches 35, and the extension portion 333 of the ground conductive terminal 33 is disposed in the center of the plug body 31, when the plug 30 is rotated in an angle of 90 degrees, the plug 30 can also be assembled onto the main body 10 of the electronic device. As shown in FIG. 4, the plug 30 can be assembled on the main body 10 of the electronic device in four different directions, and no matter the plug 30 is assembled on the main body 10 of the electronic device in what direction, the conducting pieces 16 on the plug-receiving portion 13 can be always received in the two opposite trenches 35 and contacted with either the two connection portions 322 or the two extension portions 323 of the two different conductive terminals 32, and the third conducting piece 19 is received in the cross trench 36 and contacted with the extension portion 333 of the ground conductive terminal 33, so as to conduct the external power to the main body 10 of the electronic device when the plug 30 is plugged into a socket. Therefore, by means of the structural design of the present invention, the user can choose the assembling direction of the plug 30, so that the plugging direction of the electronic device can be changed according to different requirements so as to make the electronic device have a better space utilization when plugging onto a socket.

In conclusion, the present invention provides an electronic device with a detachable plug capable of changing plugging direction. Due to the symmetrical structure of the plug body and the L-shaped connection portion and extension portion of the conductive terminal, the detachable plug can be assembled onto the main body of the electronic device in different direction so as to change the plugging direction of the electronic device according to different requirements of the users, and thus the practicability of the electronic device can be increased. Further, the number and the shapes of the conductive terminals can be varied to adapt to different socket standards, and the plug and the main body of the electronic device can be easily assembled and dissembled, which brings great convenience to the people who go abroad for business or travel frequently. Therefore, the present invention overcomes the disadvantages of the prior art and possesses industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device with a detachable plug capable of changing plugging direction, the electronic device comprising:

a main body having a plug-receiving portion, the plug-receiving portion comprising at least two conducting pieces; and a plug having a plug body and at least two conductive terminals, the plug body comprising four trenches disposed at a bottom thereof and arranged as a square, each of the conductive terminals comprising a plugging portion, a connection portion and an extension portion, wherein the plugging portion is protruded out of a surface of the plug body, and the connection portion and the extension portion are embedded in the plug body and are corresponding to two adjacent trenches, respectively;

thereby, when the plug is assembled on the plug-receiving portion of the main body, the two conducting pieces are respectively received in two opposite trenches and contacted with either the two connection portions or the two extension portions of the two conductive terminals for power conduction.

2. The electronic device with a detachable plug capable of changing plugging direction according to claim 1 wherein the electronic device is a power converter including an adapter and a charger.

3. The electronic device with a detachable plug capable of changing plugging direction according to claim 1 wherein two side plates are disposed at two opposite sides of the plug-receiving portion respectively, and the side plates are extended inwardly from bottom edges of a casing of the main body.

4. The electronic device with a detachable plug capable of changing plugging direction according to claim 3 wherein each of the side plates has an indentation.

5. The electronic device with a detachable plug capable of changing plugging direction according to claim 4 wherein the plug has four flanges disposed at a bottom surface thereof, and any two adjacent flanges are corresponding to and able to be received in the two indentations of the two side plates in the plug-receiving portion.

6. The electronic device with a detachable plug capable of changing plugging direction according to claim 1 wherein the connection portion and the extension portion of the conductive terminal are substantially in an L-form.

7. The electronic device with a detachable plug capable of changing plugging direction according to claim 1 wherein the plug-receiving portion further comprises a third conducting piece disposed in a center of the plug-receiving portion.

8. The electronic device with a detachable plug capable of changing plugging direction according to claim 1 wherein the plug further comprises a ground conductive terminal having a plugging portion, a connection portion and an extension portion.

9. The electronic device with a detachable plug capable of changing plugging direction according to claim 1 wherein the main body further comprises a locking component having a locking latch and a release button, and the locking latch is used to be engaged with one of the trenches on the plug.

10. The electronic device with a detachable plug capable of changing plugging direction according to claim 1 wherein the plug-receiving portion further comprises a block for preventing the plug from being assembled to the main body from incorrect direction.

11. The electronic device with a detachable plug capable of changing plugging direction according to claim 1 wherein the four trenches are communicated with each other to form a surrounding trench.

12. A plug to be assembled on a plug-receiving portion of a main body of an electronic device, the plug-receiving portion comprising at least two conducting pieces, the plug comprising:

a plug body comprising four trenches disposed at a bottom thereof and arranged as a square; and at least two conductive terminals, each of the conductive terminals comprising a plugging portion, a connection portion and an extension portion, wherein the plugging portion is protruded out of a surface of the plug body, and the connection portion and the extension portion are embedded in the plug body and are corresponding to two adjacent trenches, respectively;

thereby, when the plug is assembled on the plug-receiving portion of the main body, the two conducting pieces are respectively received in two opposite trenches and contacted with either the two connection portions or the two extension portions of the two conductive terminals for power conduction.

13. The plug according to claim 12 wherein the connection portion and the extension portion of the conductive terminal are substantially in an L-form.

14. The plug according to claim 12 wherein the plug-receiving portion further comprises a third conducting piece disposed in a center of the plug-receiving portion.

15. The plug according to claim 14 wherein the plug body further comprises a cross trench disposed at the bottom thereof and extended from a center of the plug body to the four trenches.

16. The plug according to claim 15 wherein the plug further comprises a ground conductive terminal having a plugging portion, a connection portion and an extension portion.

17. The plug according to claim 16 wherein when the plug is assembled on the plug-receiving portion of the main body, the third conducting piece is received in the cross trench and contacted with the extension portion of the ground conductive terminal for power conduction.

18. The plug according to claim 12 wherein the four trenches are communicated with each other to form a surrounding trench.

19. An electronic device with a detachable plug capable of changing plugging direction, the electronic device comprising:

a main body having a plug-receiving portion, the plug-receiving portion comprising at least two conducting pieces; and a plug having a plug body and at least two conductive terminals, the plug body comprising a surrounding trench, which is formed by four trenches arranged as a square, disposed at a bottom thereof, each of the conductive terminals comprising a plugging portion, a connection portion and an extension portion, wherein the plugging portion is protruded out of a surface of the plug body, and the connection portion and the extension portion are embedded in the plug body and are corresponding to two adjacent trenches, respectively;

thereby, when the plug is assembled on the plug-receiving portion of the main body, the two conducting pieces are received in the surrounding trench and contacted with either the two connection portions or the two extension portions of the two conductive terminals for power conduction.

* * * * *